US012285139B1

(12) United States Patent
Chen

(10) Patent No.: US 12,285,139 B1
(45) Date of Patent: Apr. 29, 2025

(54) PEDESTAL TYPE TOILET FOR CHILDREN

(71) Applicant: Taizhou Tongchuang Maternal and Infant products Co., Ltd., Taizhou (CN)

(72) Inventor: Hui Chen, Taizhou (CN)

(73) Assignee: Taizhou Tongchuang Maternal and Infant products Co., Ltd., Taizhou (CN)

( * ) Notice: Subject to any disclaimer, the term of this patent is extended or adjusted under 35 U.S.C. 154(b) by 0 days.

(21) Appl. No.: 18/975,818

(22) Filed: Dec. 10, 2024

(30) Foreign Application Priority Data

Dec. 2, 2024 (CN) ..... 202422958785.5

(51) Int. Cl.

| | |
|---|---|
| ***A47K 11/06*** | (2006.01) |
| ***A47K 11/00*** | (2006.01) |
| ***E03D 1/26*** | (2006.01) |
| ***E03D 11/02*** | (2006.01) |

(52) U.S. Cl.
CPC ..... *A47K 11/06* (2013.01); *A47K 11/00* (2013.01); *E03D 1/26* (2013.01); *E03D 11/025* (2013.01)

(58) Field of Classification Search
CPC ..... A47K 11/00; A47K 11/06; E03D 11/025; E03D 1/26
USPC ..... 4/111.5, 420, 449, 450, 457, 464, 902, 4/483; D23/296, 299
See application file for complete search history.

(56) References Cited

U.S. PATENT DOCUMENTS

| | | | | |
|---|---|---|---|---|
| 11,330,942 | B1 * | 5/2022 | Bergman | A47K 11/04 |
| 11,793,369 | B1 * | 10/2023 | Yang | A47K 11/04 |

* cited by examiner

*Primary Examiner* — Tuan N Nguyen

(57) ABSTRACT

A pedestal type toilet for children includes a bottom support main body, an upper support main body detachably connected to the bottom support main body, a toilet seat component detachably arranged on the upper support main body, a water tank detachably arranged on the toilet seat component or the upper support main body, and a bedpan detachably arranged on the toilet seat component. When in a storage state, the bottom support main body is at least partially placed inside the upper support main body, and the bedpan and the water tank are both at least partially placed inside the bottom support main body. When in a usage state, the bottom support main body is positioned below the upper support main body, and the toilet seat component is positioned above the upper support main body and is configured for limiting a position of the bedpan.

20 Claims, 17 Drawing Sheets

PEDESTAL TYPE TOILET FOR CHILDREN

CROSS-REFERENCE TO RELATED APPLICATIONS

The application claims priority of Chinese patent application CN2024229587855, filed on Dec. 2, 2024, which is incorporated herein by reference in its entireties.

TECHNICAL FIELD

The present invention relates to the technical field of toilets, particularly to a pedestal type toilet for children.

BACKGROUND ART

Existing conventional household toilets have heights and sizes that are inconvenient for children to use. Therefore, children's toilets have emerged on the market to facilitate children to use the toilet. However, currently, the existing children's toilets that imitate household toilets are bulky, inconvenient for product transportation, and inconvenient for users to carry and use outside, and do not have the flushing function of imitating household toilets.

SUMMARY

The main purpose of the present invention is to provide a pedestal type toilet, for solving the problems that existing children's toilets that imitate household toilets are bulky, inconvenient to transport, and inconvenient to carry and use outside.

In order to solve the above technical problems, the technical solution provided by the present invention is as follows.

A pedestal type toilet for children includes:

a bottom support main body;

an upper support main body detachably connected to the bottom support main body;

a toilet seat component detachably arranged on the upper support main body;

a water tank detachably arranged on the toilet seat component or the upper support main body; and a bedpan detachably arranged on the toilet seat component.

When in a storage state, the bottom support main body is at least partially placed inside the upper support main body, and the bedpan and the water tank are both at least partially placed inside the bottom support main body.

When in a usage state, the bottom support main body is positioned below the upper support main body, the toilet seat component is positioned above the upper support main body and is configured for limiting a position of the bedpan, the bedpan is at least partially placed inside the upper support main body, and the water tank is positioned behind the bedpan and above the upper support main body.

Furthermore, a first embedding groove is defined in an upper surface of the bottom support main body. The bottom support main body is provided with first engaging openings on a side wall of the first embedding groove. A bottom portion of the upper support main body protrudes downward to form a first connecting flange. First engaging blocks are provided on a side wall of the first connecting flange.

When in the usage state, the first connecting flange is placed in the first embedding groove, a bottom portion of the first connecting flange is in contact with a bottom portion of the first embedding groove, and the first engaging block is placed in the first engaging opening.

Furthermore, the upper support main body is in a hollow form, and a top portion of the upper support main body is a first opening.

The first connecting flange is provided with a first avoidance opening at a position corresponding to the first engaging block. The first engaging block includes a first support portion connected to the first connecting flange, and a first convex block arranged on a side wall of the first support portion. A thickness of the first convex block gradually decreases at least partially in a direction close to the bottom support main body. The first avoidance opening and the first support portion are displayed in a projection of the upper support main body from top to bottom.

Furthermore, the bottom support main body is in a hollow form, and a bottom portion of the bottom support main body is a second opening.

A plurality of ribs are arranged around an inner side wall of the bottom support main body for enhancing strength of the bottom support main body. Anti-slip pads are provided at the bottom portion of the bottom support main body.

Furthermore, the toilet seat component includes a toilet ring, a seat ring, and a toilet lid. The toilet ring is detachably arranged on the upper support main body. The seat ring is rotatably arranged on the toilet ring, and the seat ring is configured to be detachably arranged on the toilet ring. The toilet lid is rotatably arranged on the toilet ring. The seat ring is positioned between the toilet ring and the toilet lid.

A third opening is defined in the toilet ring. The third opening is in communication with an inner portion of the upper support main body. The bedpan is provided with a support rim. The bedpan is placed inside the third opening. The support rim is positioned above an upper surface of the toilet ring.

Furthermore, the toilet ring is provided with a second embedding groove on a peripheral side corresponding to the third opening. The second embedding groove is adapted for use with the support rim. The support rim is placed in the second embedding groove.

Furthermore, a front end of the bedpan is formed with a flow guide portion for easy pouring of excrement.

Furthermore, the toilet ring protrudes upward on a rear side of the third opening to form at least two first connecting columns. The at least two first connecting columns are spaced apart. A side wall of the first connecting column protrudes to form a first rotating shaft portion. The toilet lid protrudes at a position near an end portion to form a second connecting column. A first shaft hole is defined in a side wall of the second connecting column. The first rotating shaft portion is placed inside the first shaft hole.

Furthermore, the seat ring is provided with a second avoidance opening at a position corresponding to the second connecting column. The toilet ring is provided with a third avoidance opening at a position corresponding to rotation of the seat ring.

Furthermore, a bottom portion of the seat ring is provided with a cushion pad for preventing collision with the toilet ring.

An upper surface of the seat ring is provided with a seat cushion for increasing user comfort Furthermore, the upper surface of the seat ring is recessed downward to form a third embedding groove. The seat cushion is at least partially placed in the third embedding groove.

The seat ring is provided with a plurality of second engaging openings on a side wall corresponding to the third embedding groove. An outer side of the seat cushion is provided with a second engaging block adapted for use with the second engaging opening.

Furthermore, the toilet ring protrudes upward on a rear side of the third opening to form at least two third connecting columns. The at least two third connecting columns are spaced apart. A side wall of the third connecting column protrudes to form a second rotating shaft portion. The seat ring protrudes at a position near an end portion to form a fourth connecting column. A second shaft hole is defined in the fourth connecting column. The second rotating shaft portion is placed in the second shaft hole when the seat ring is assembled to the toilet ring.

Furthermore, the second rotating shaft portion is provided with a position limiting convex block. The position limiting convex block is arranged opposite to the third connecting column. The fourth connecting column is provided with an installation opening for allowing the position limiting convex block to pass through. The installation opening is in communication with the second shaft hole.

The position limiting convex block is at least partially misaligned with the installation opening when the seat ring is in the use state and the open state.

Furthermore, a partition plate is detachably provided inside the water tank. The partition plate is used for dividing an interior of the water tank into an upper chamber and a lower chamber. The upper chamber and the lower chamber are distributed up and down. The upper chamber is used for storing items. The water tank is internally equipped with a drawable hanging rod. The hanging rod is at least partially placed inside the lower chamber. The water tank is provided with a through hole for communication with the upper chamber.

Furthermore, a position limiting rod is provided inside the lower chamber. A storage chamber is defined in the position limiting rod. The storage chamber is adapted to the hanging rod and used for storing the hanging rod. The position limiting rod is at least partially placed inside the storage chamber. One end of the position limiting rod is fixed to the water tank.

Furthermore, a fourth opening is defined in a top portion of the water tank. The fourth opening is in communication with the upper chamber and facilitates a user to place items into the upper chamber. A cover plate is rotationally provided on the water tank at a position corresponding to fourth opening. The cover plate is used for covering the fourth opening.

Furthermore, the water tank is equipped with a sound emitting module for emitting a sound of toilet flushing.

The sound emitting module includes an outer shell, a circuit board positioned inside the outer shell, a speaker, and an operation key for user operation. The speaker and the operation key are both electrically connected to the circuit board. When the operation key is operated, the circuit board drives the speaker to emit the sound of toilet flushing.

Furthermore, the operation key includes a trigger switch, a rotating member, and a restoration member. The trigger switch is arranged on the circuit board. The rotating member is rotationally provided on the outer shell. The rotating member is partially placed inside the outer shell. The rotating member is provided with a pressing member at a position within the outer shell. When the rotating member is operated to rotate, the pressing member rotates together and presses the trigger switch. The circuit board drives the speaker to emit the sound of toilet flushing when the trigger switch is pressed. The restoration member is configured for generating a restoration force after the rotating member is rotated, so as to drive the rotating member back to a position before rotation.

Furthermore, the water tank includes a tank body with a fifth opening at a top portion, and a front shell detachably arranged on the tank body. The bedpan is at least partially placed inside the tank body when in the storage state. The bottom support main body is provided with a first position limiting chamber for limiting a position of the tank body. The tank body is placed in the first position limiting chamber when in the storage state.

Furthermore, a bottom portion of the tank body protrudes downward to form a second connecting flange. A third engaging block is provided on a side wall of the second connecting flange. A fourth embedding groove is defined in an upper surface of the toilet ring. The toilet ring is provided with a third engaging opening on a side wall of the fourth embedding groove. When in the usage state, the second connecting flange is placed in the fourth embedding groove, and a bottom portion of the second connecting flange is in contact with a bottom portion of the fourth embedding groove. The third engaging block is placed in the third engaging opening.

The second connecting flange is provided with a fourth avoidance opening at a position corresponding to the third engaging block. The third engaging block includes a second support portion connected to the second connecting flange, and a second convex block provided on a side wall of the second support portion. A thickness of the second convex block gradually decreases at least partially in a direction close to the toilet ring. The fourth avoidance opening and the second support portion are displayed in a projection of the tank body from top to bottom.

The present invention has the following beneficial effects. Compared with the prior art, in the present invention, the bottom support main body and the toilet seat component are both detachably connected to the upper support main body, the water tank is detachably arranged on the upper support main body and the toilet seat component, and the bedpan is detachably arranged on the toilet seat component. Therefore, during storage, the bottom support main body is at least partially placed inside the upper support main body, the bedpan and the water tank are both at least partially placed inside the bottom support main body, and then the toilet seat component can be positioned on an outside of the upper support main body and an outside of the bottom support main body, thereby playing a storage role, effectively reducing the volume of the product during carrying and transportation, and facilitating transportation and outdoor carrying.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
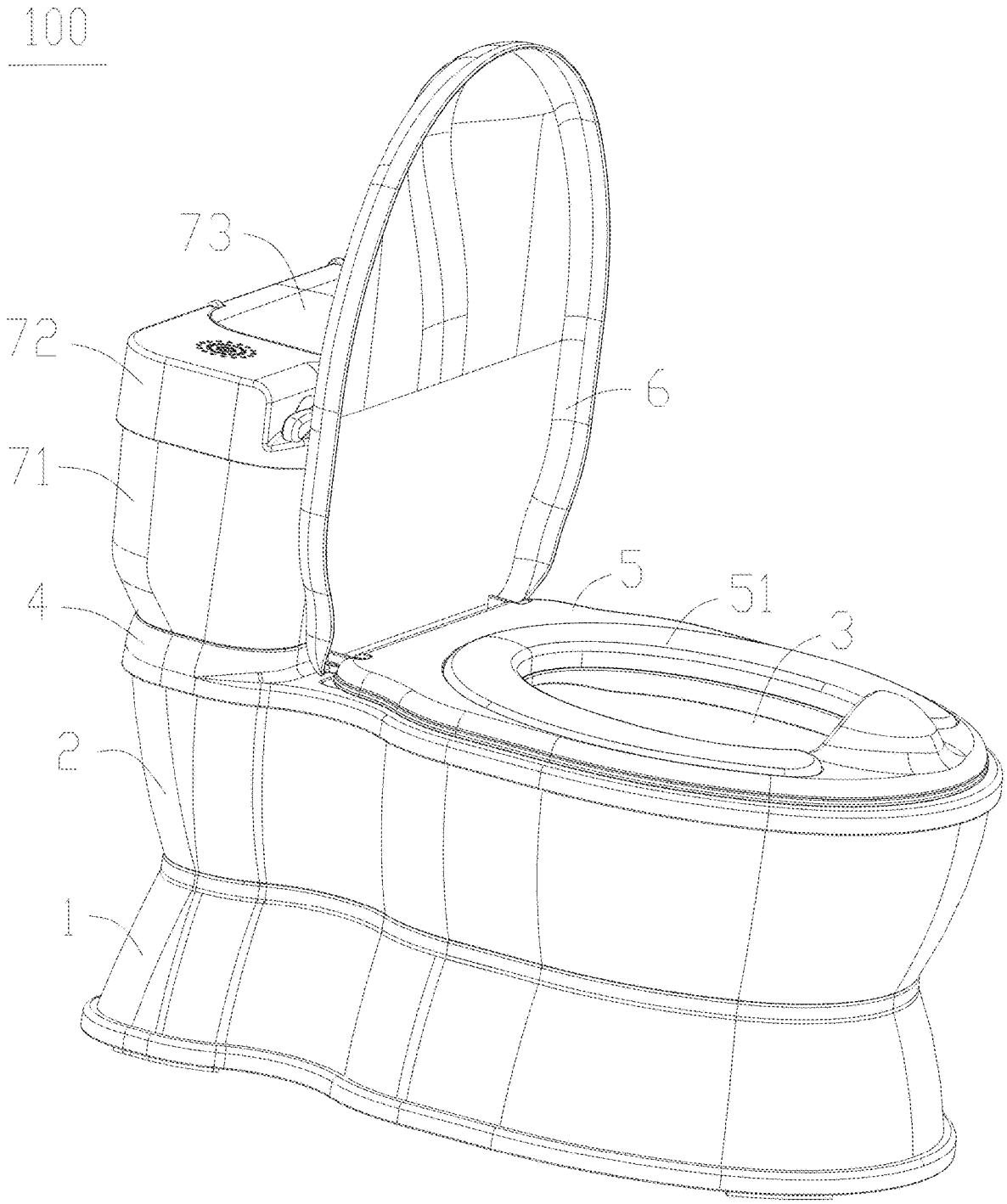
FIG. 1 is a perspective view of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

Figure 2:
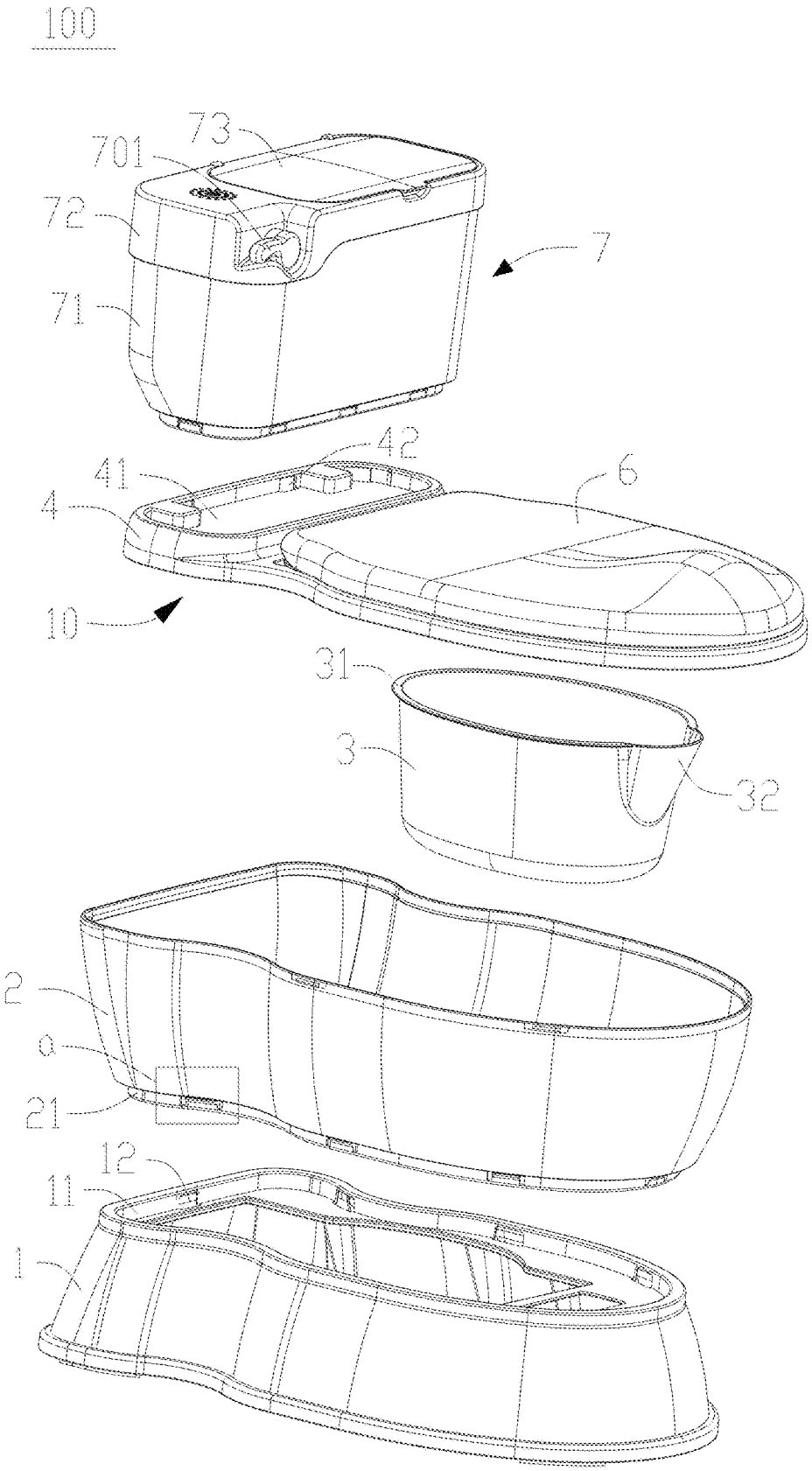
FIG. 2 is an exploded view of the present invention.
Figure 3:
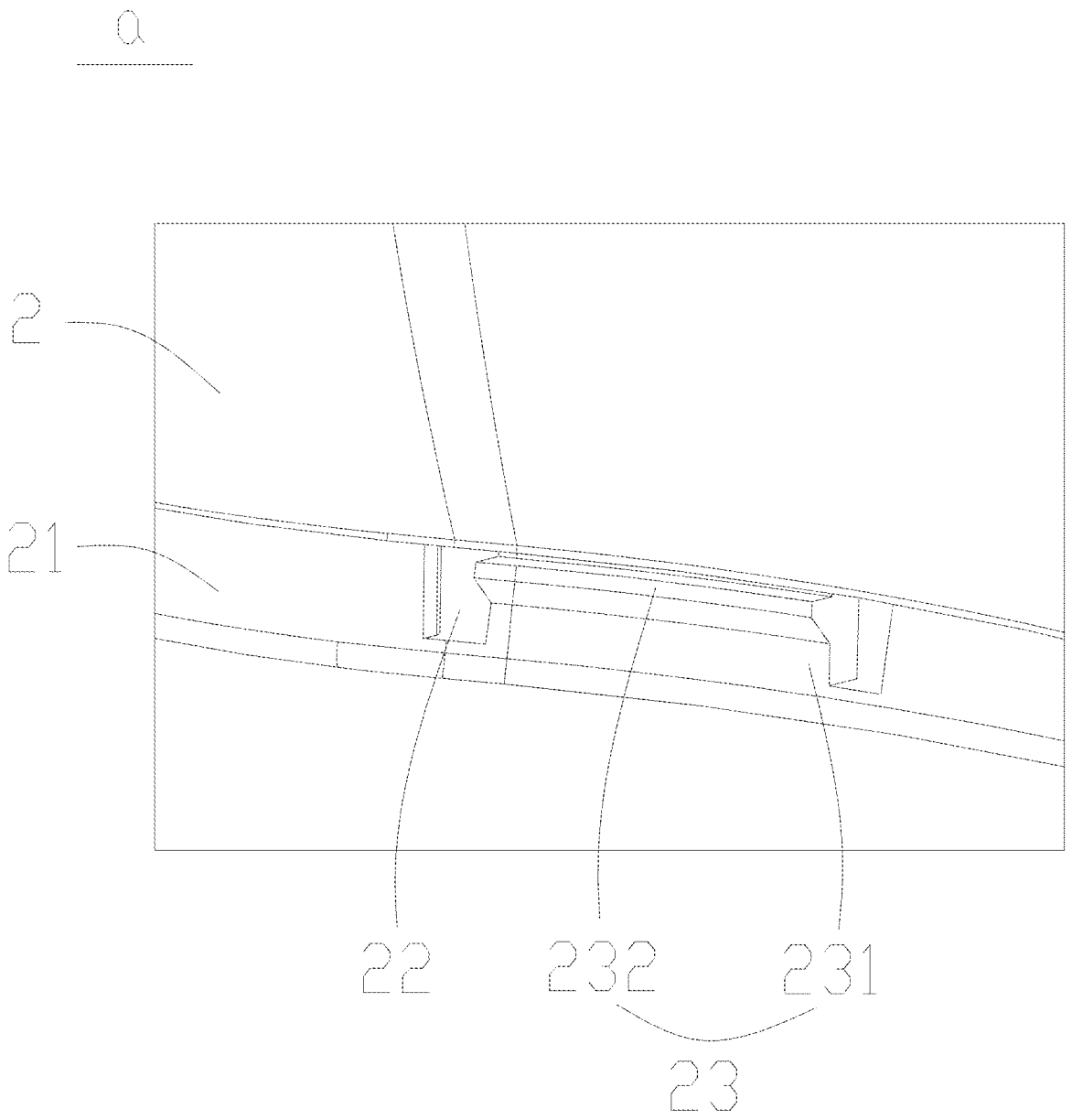
FIG. 3 is an enlarged view of area a in FIG. 2.
Figure 4:
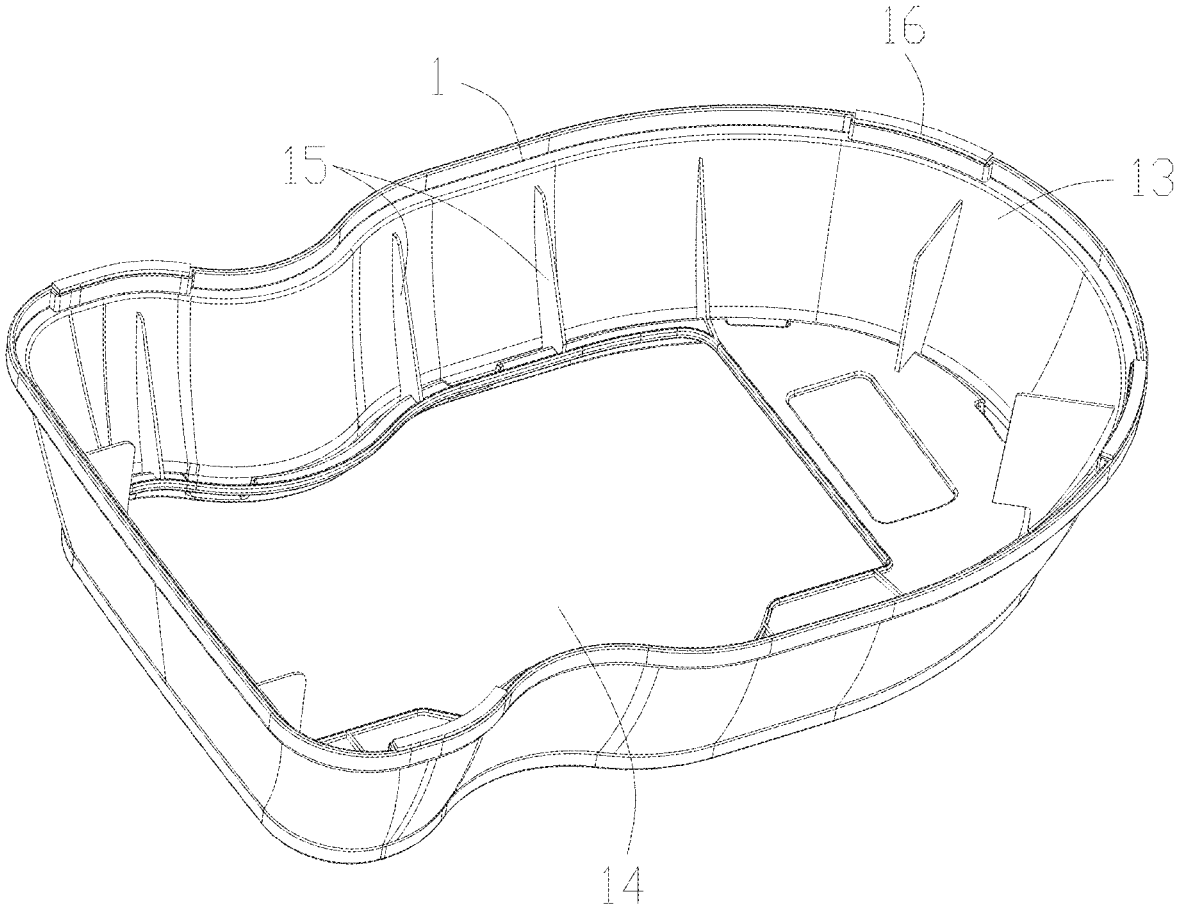
FIG. 4 is a structural diagram of a bottom support main body of the present invention.
Figure 5:
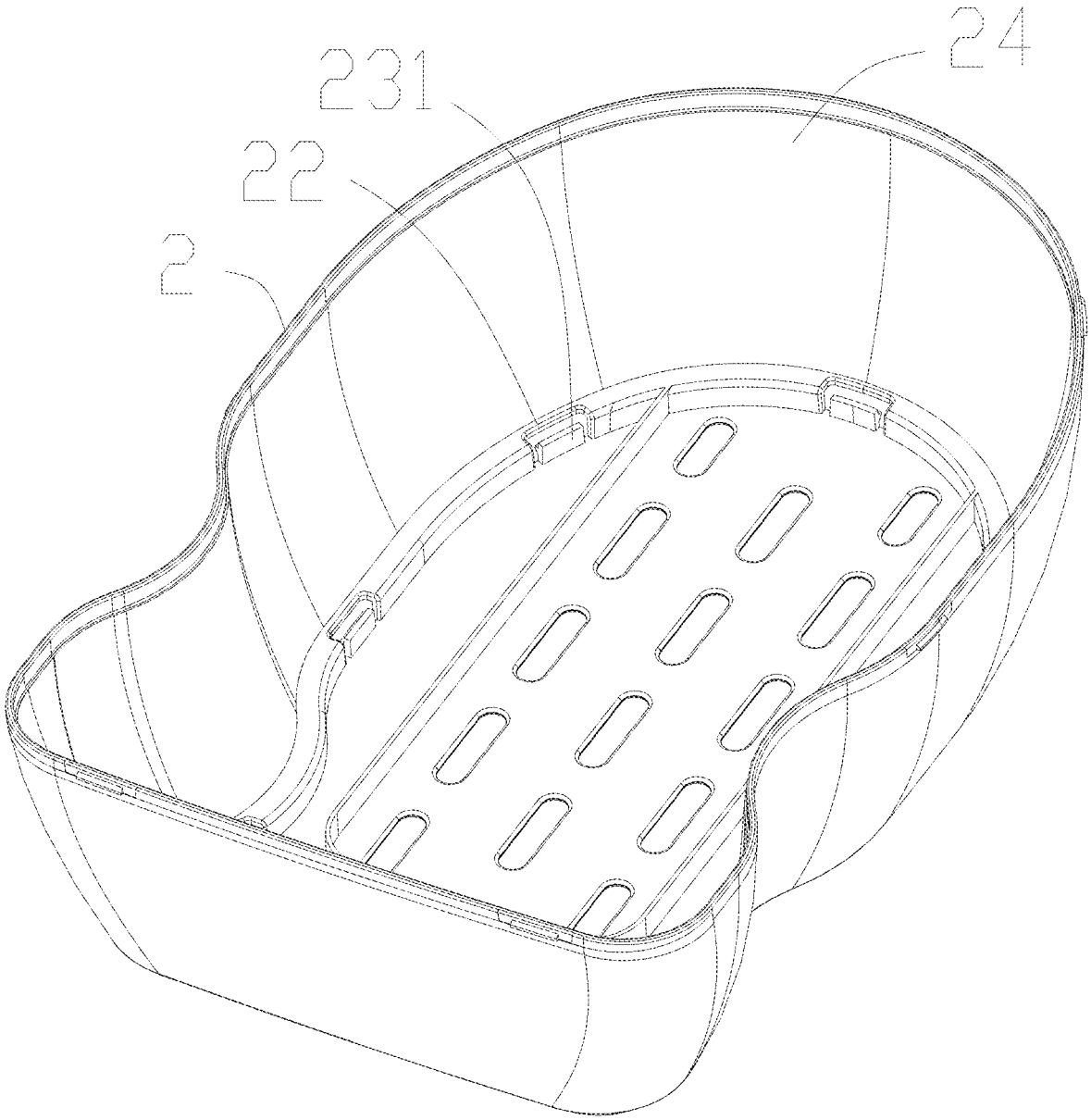
FIG. 5 is a structural diagram of an upper support main body of the present invention.
Figure 6:
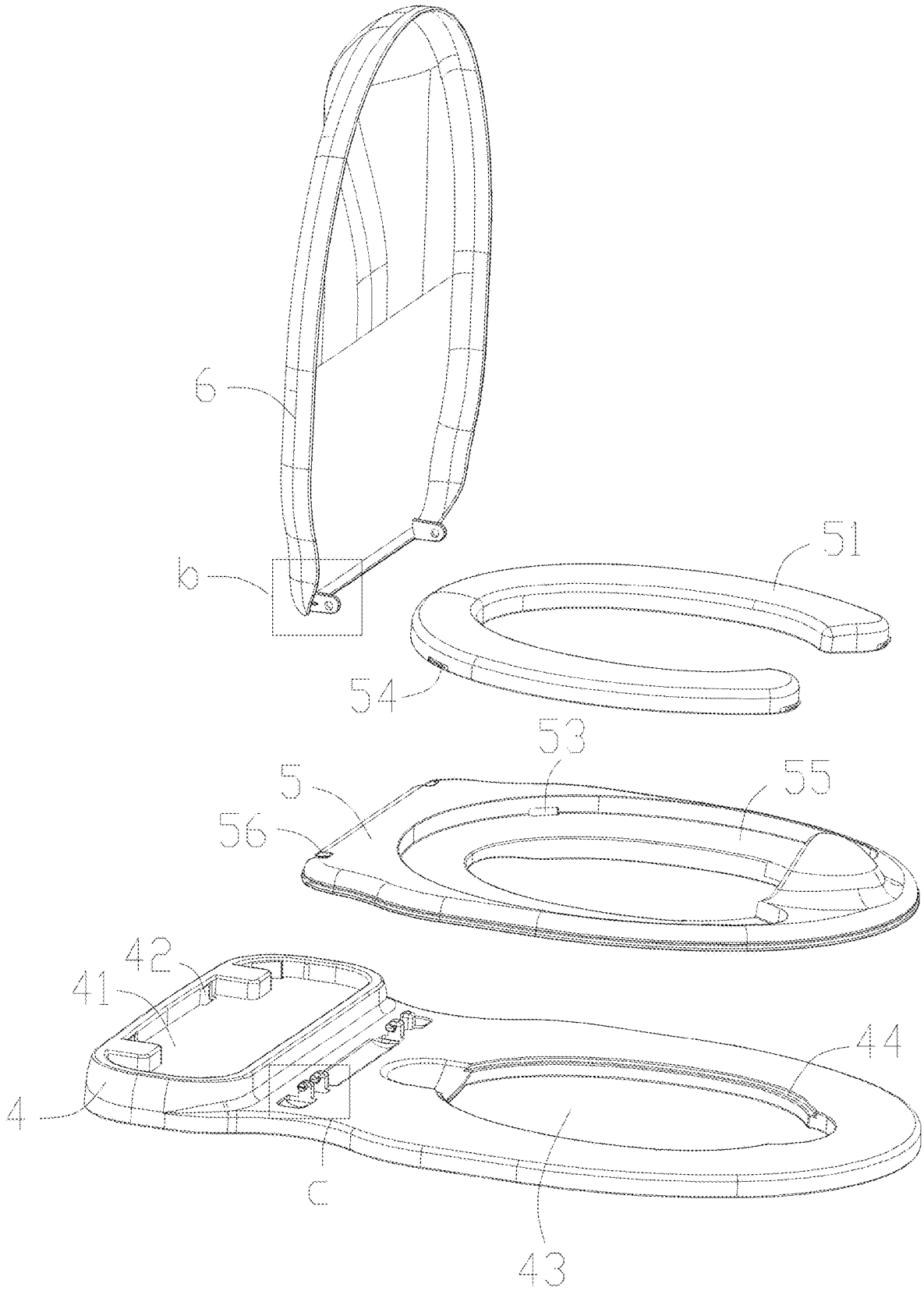
FIG. 6 is an exploded view of a toilet seat component of the present invention.
Figure 7:
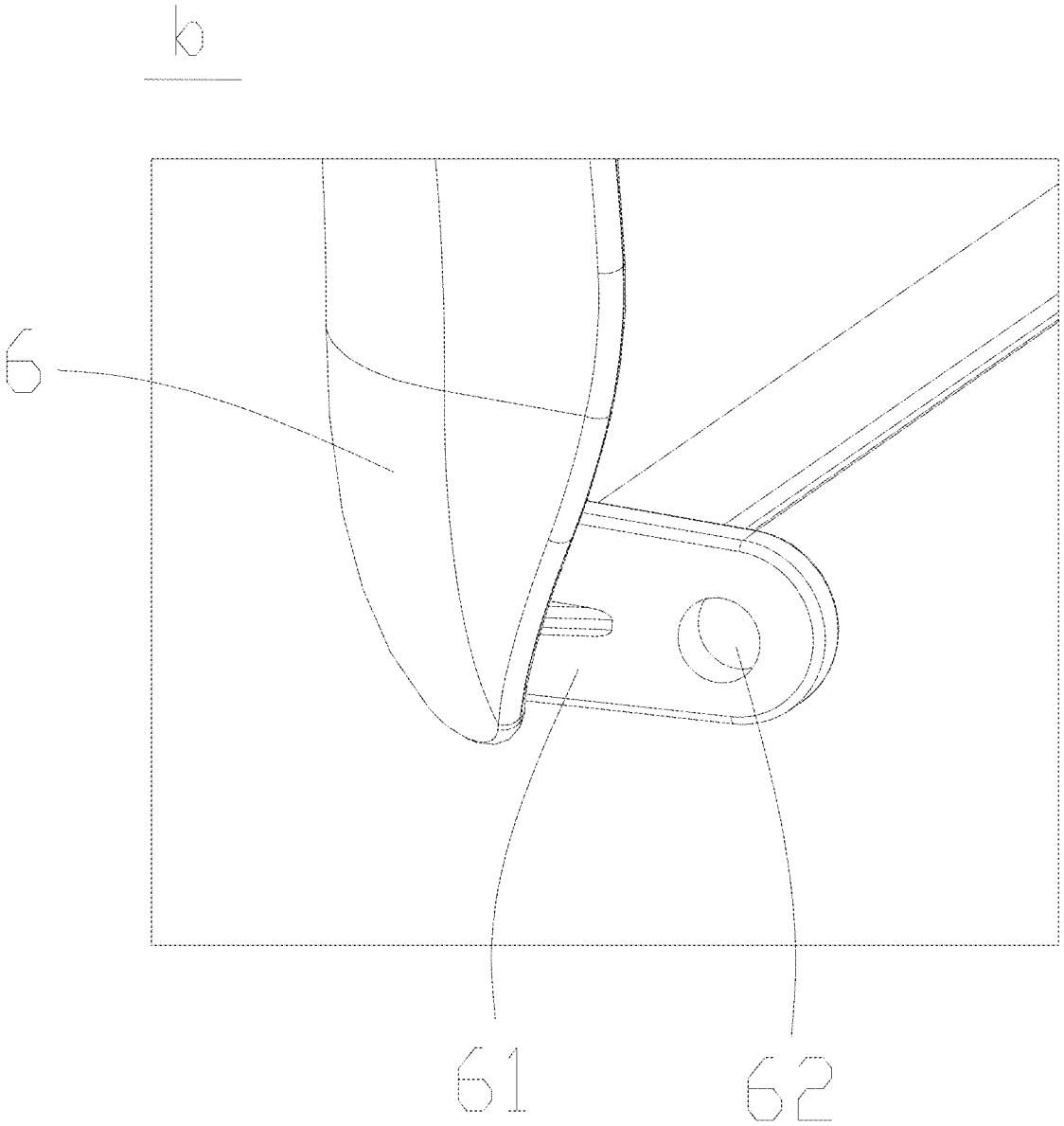
FIG. 7 is an enlarged view of area b in FIG. 6.
Figure 8:
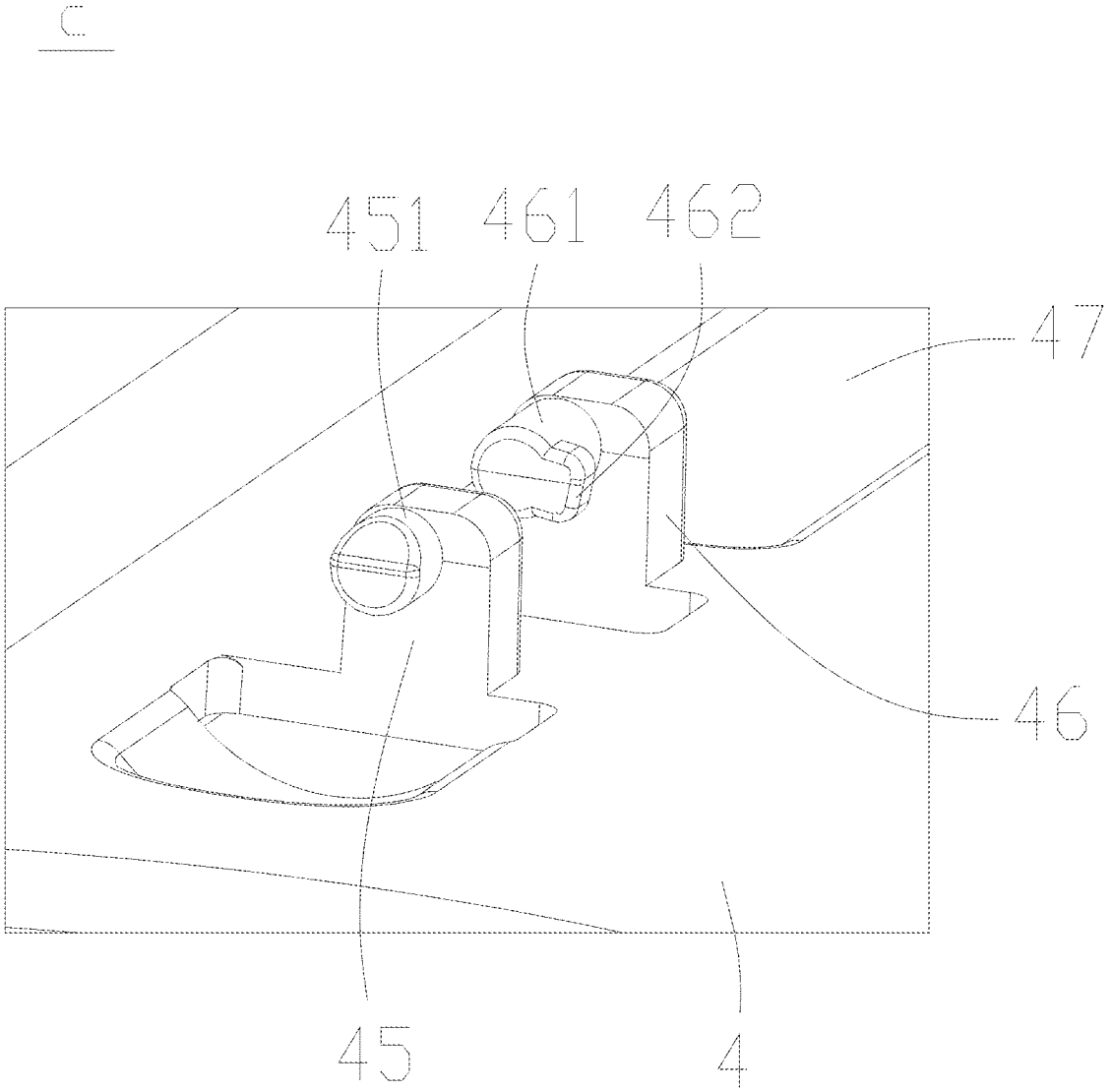
FIG. 8 is an enlarged view of area c in FIG. 6.
Figure 9:
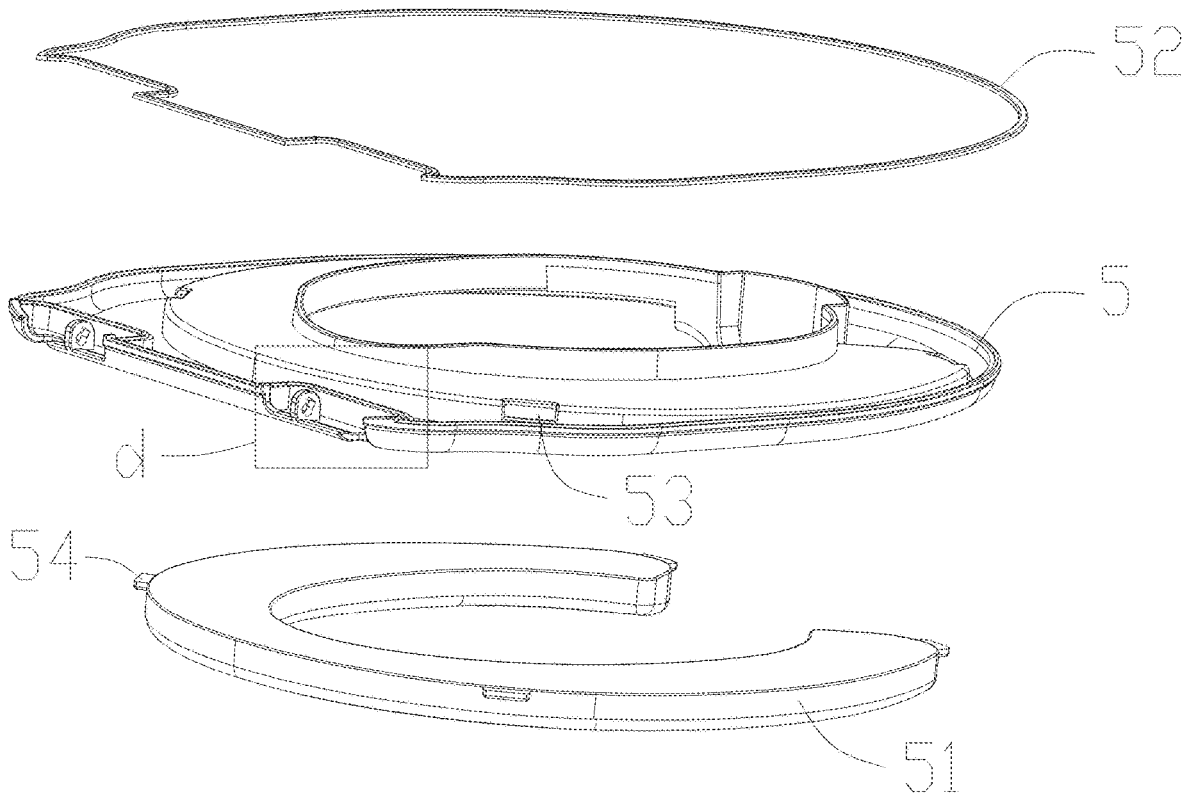
FIG. 9 is an exploded view of a seat ring, a seat cushion, and a cushion pad of the present invention.
Figure 10:
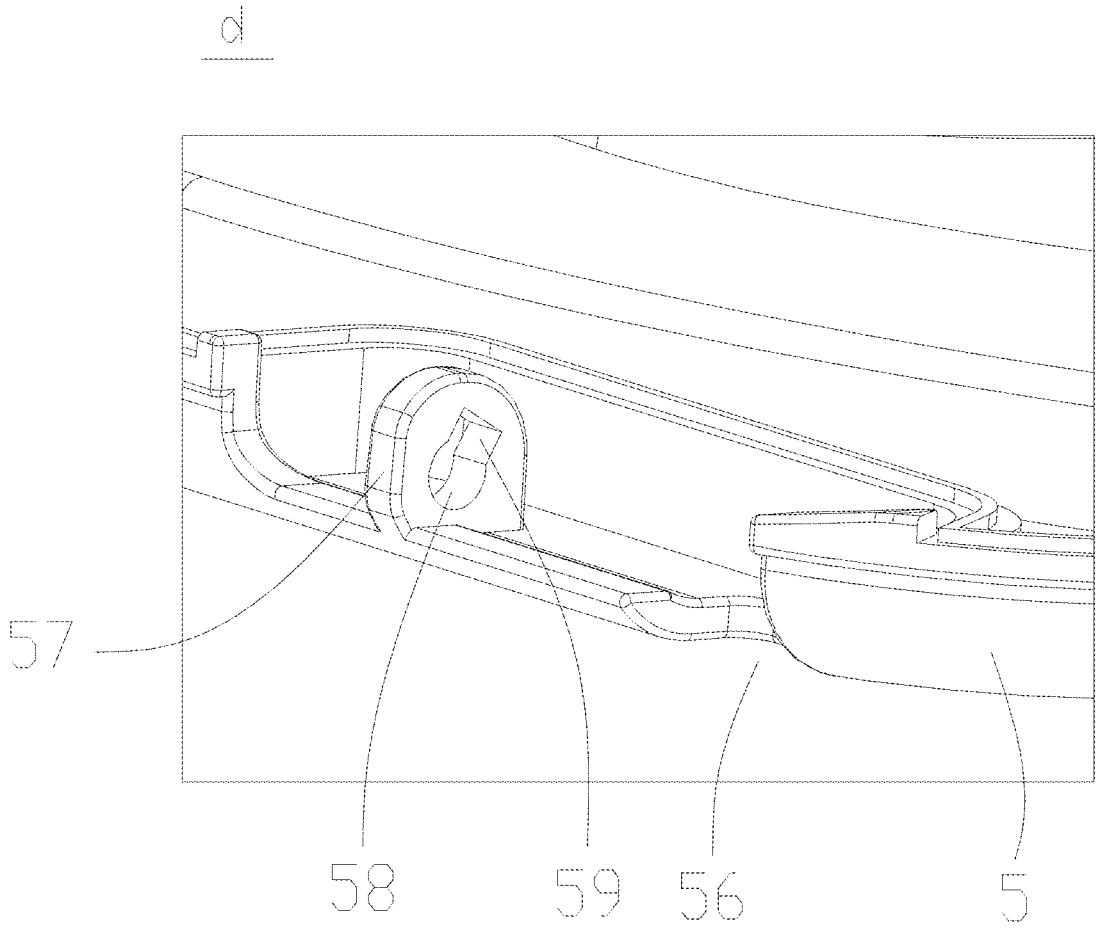
FIG. 10 is an enlarged view of area d in FIG. 9.
Figure 11:
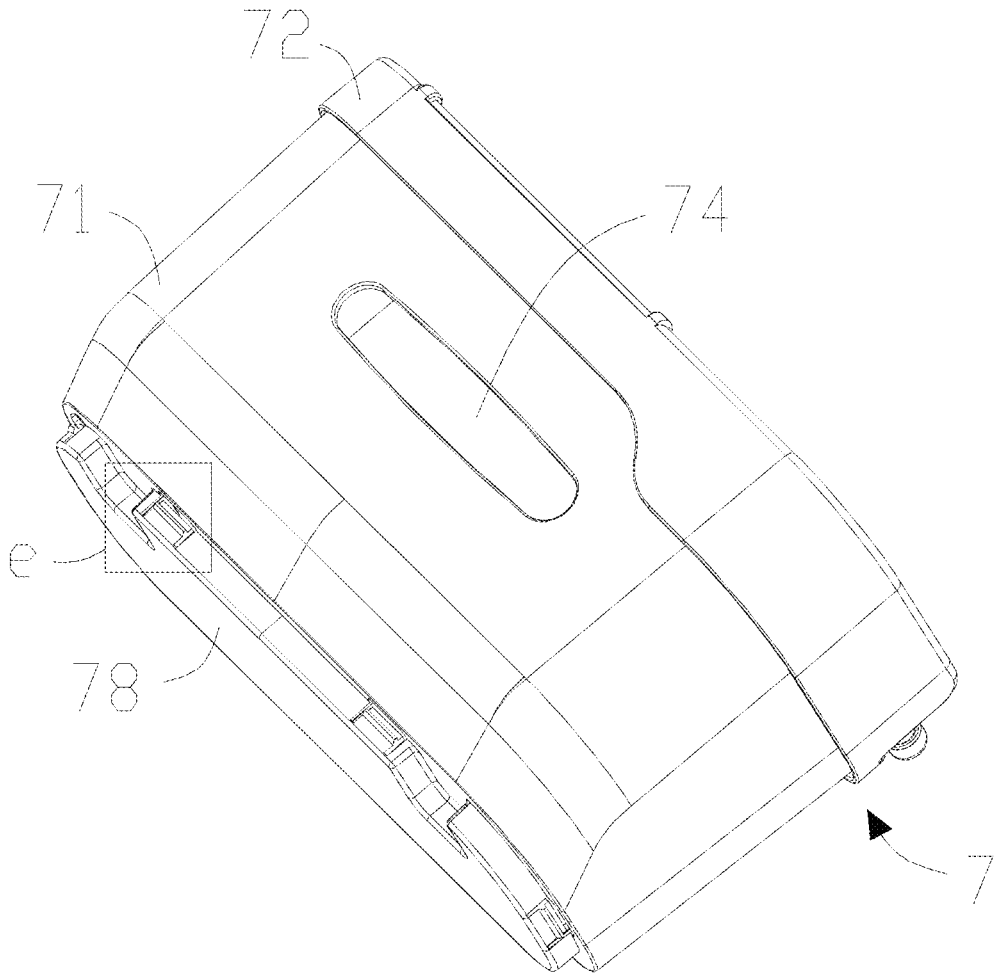
FIG. 11 is a perspective view of a water tank of the present invention.
Figure 12:
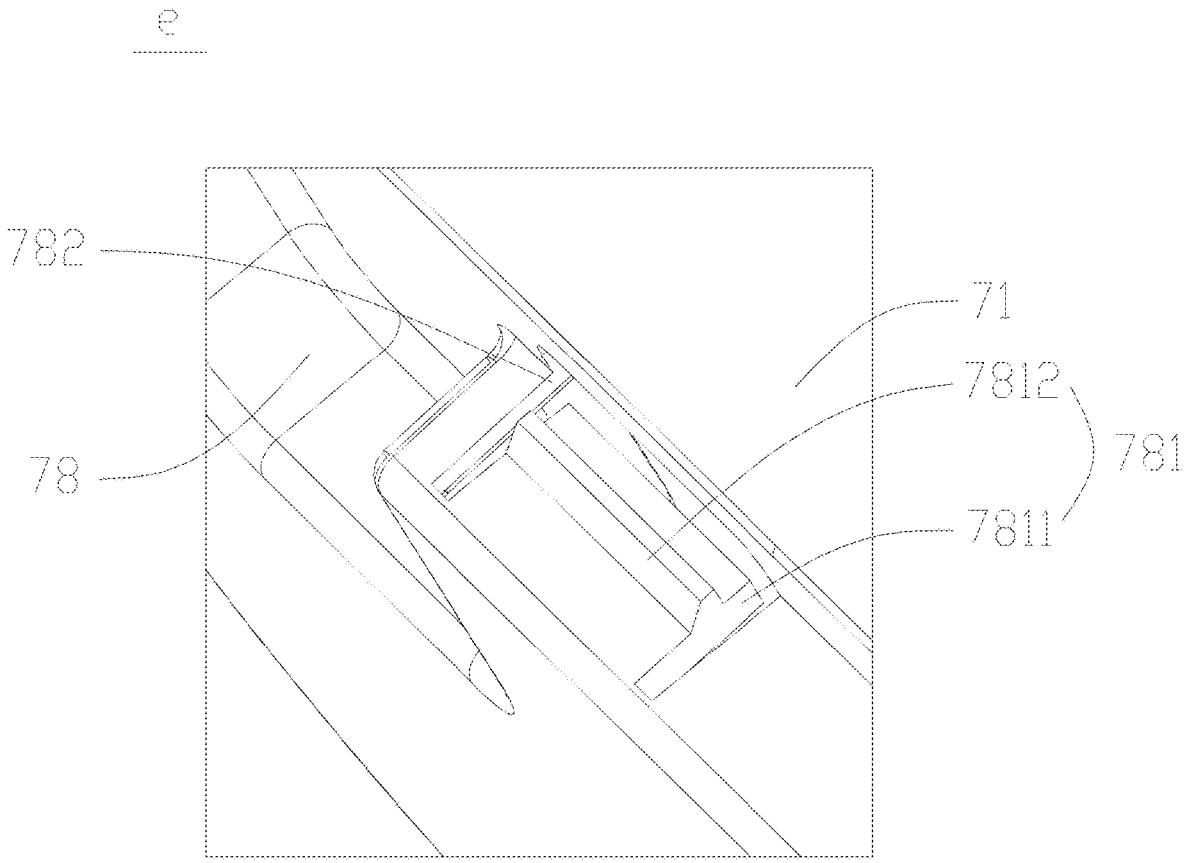
FIG. 12 is an enlarged view of area e in FIG. 11.
Figure 13:
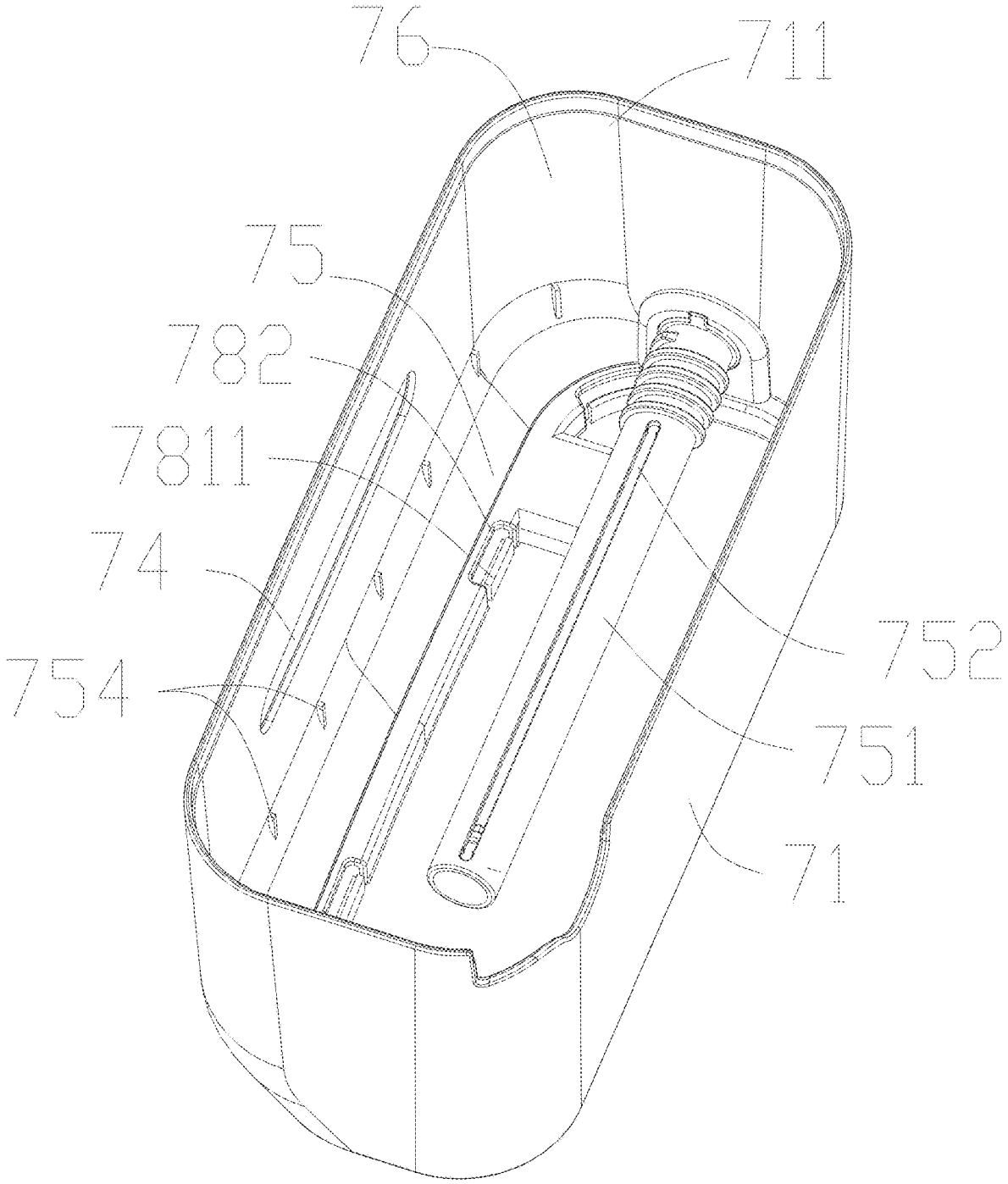
FIG. 13 is a schematic diagram of a water tank of the present invention with a front shell and a partition plate removed.
Figure 14:
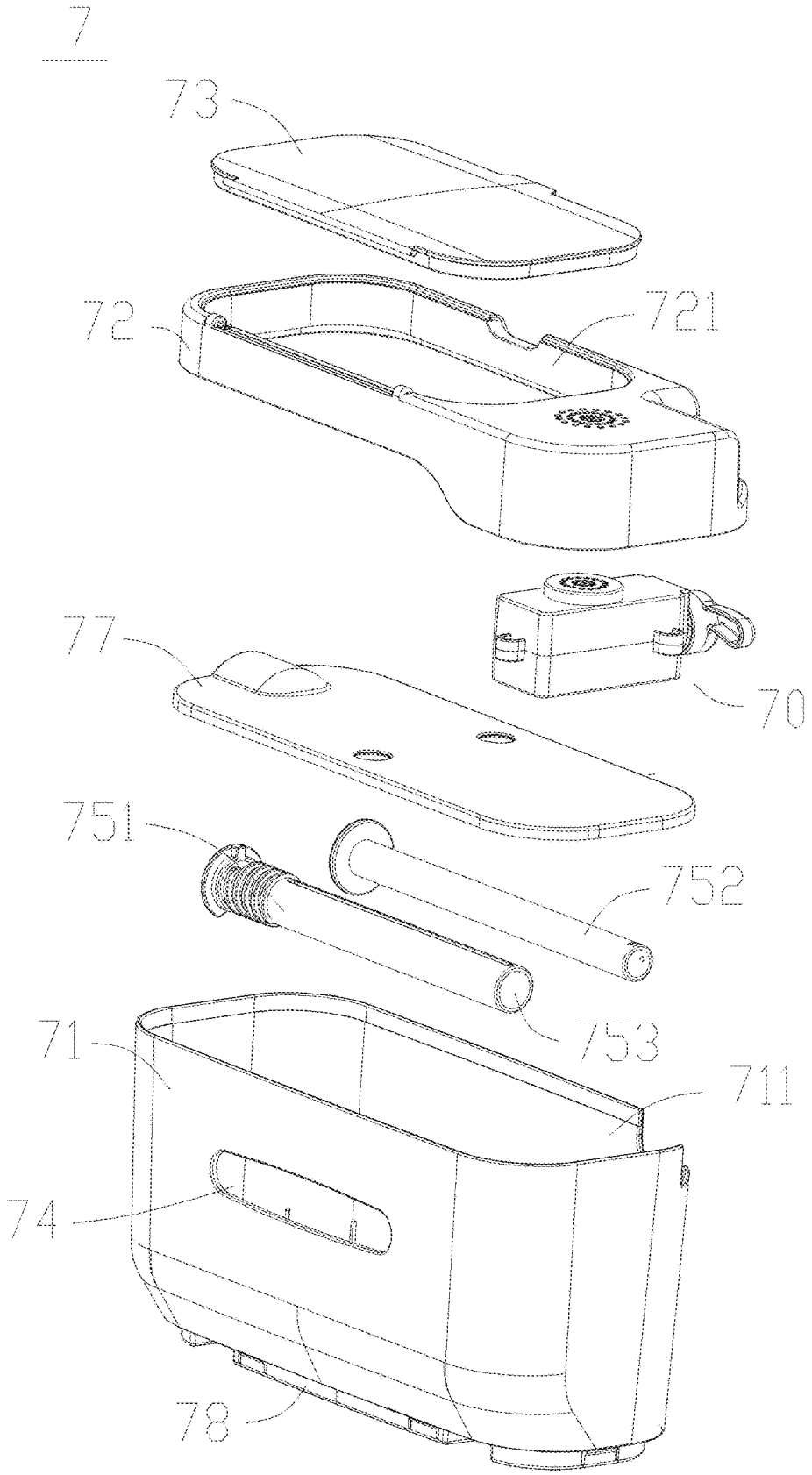
FIG. 14 is an exploded view of a water tank of the present invention.
Figure 15:
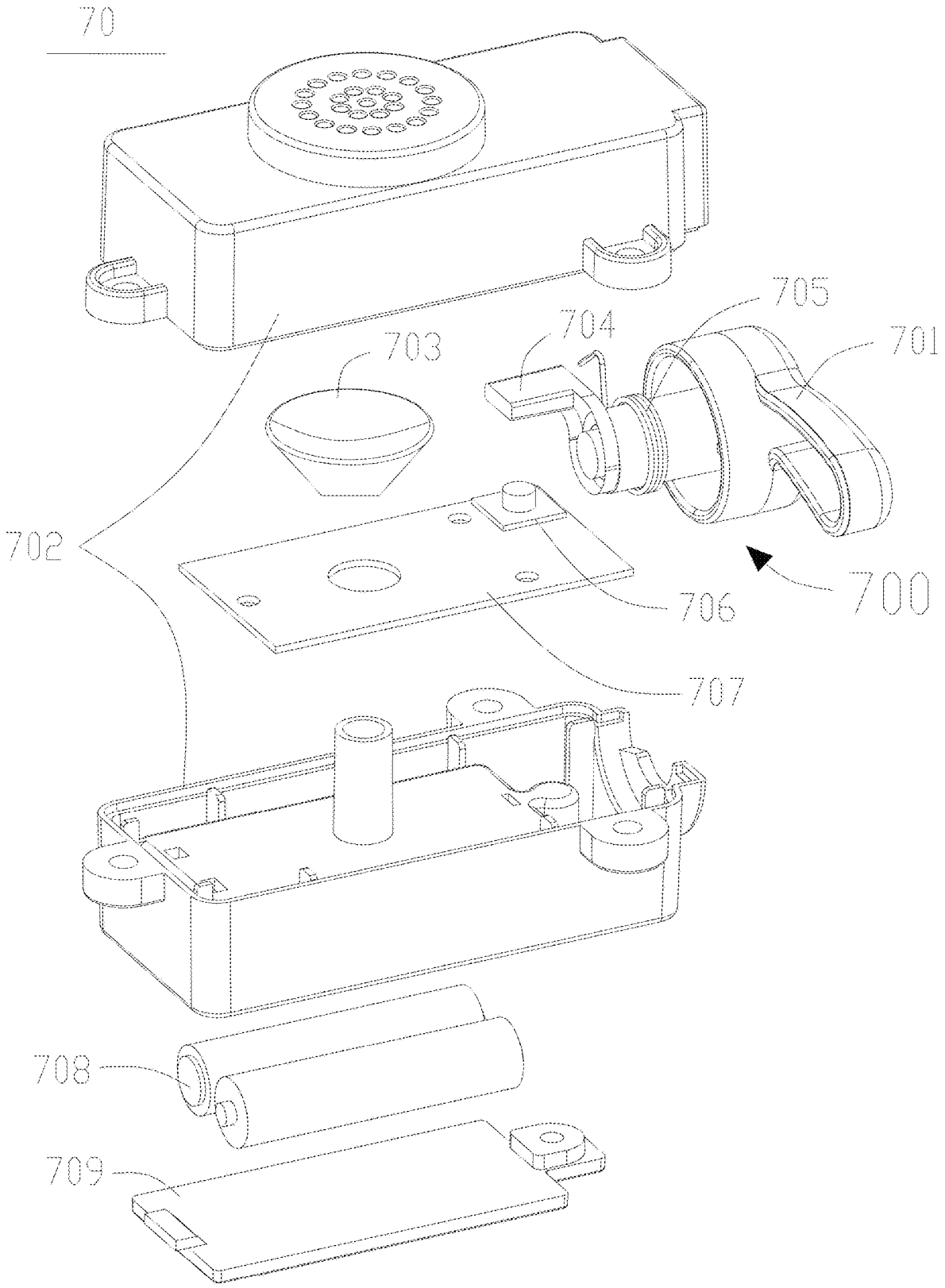
FIG. 15 is an exploded view of a sound emitting module of the present invention.
Figure 16:
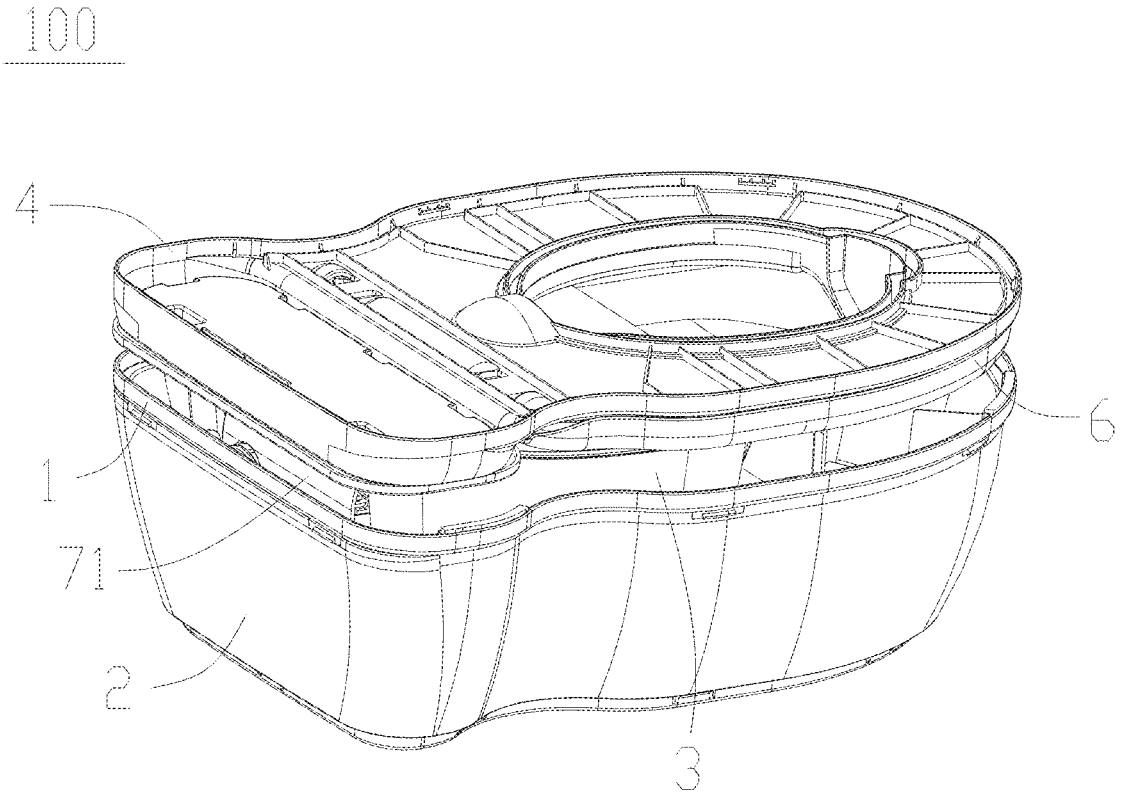
FIG. 16 is a schematic diagram of a storage state of the present invention.
Figure 17:
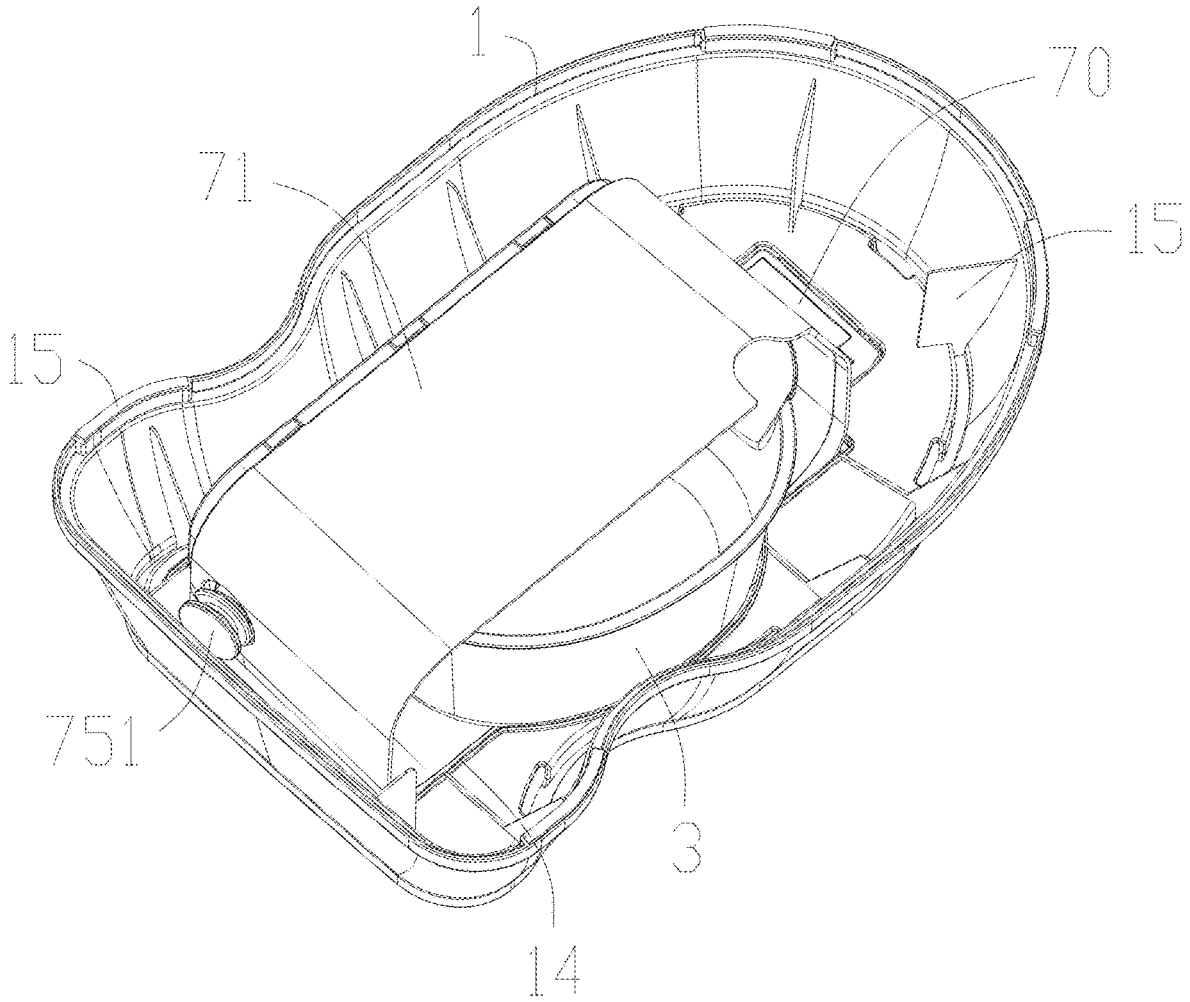
FIG. 17 is a schematic diagram of the present invention in a storage state and with a toilet seat component and a partition plate removed.

Referring to FIGS. 1-17, a pedestal type toilet 100 is provided in an embodiment of the present invention.

The pedestal type toilet 100 includes a bottom support main body 1, an upper support main body 2 detachably connected to the bottom support main body 1, a toilet seat component 10 detachably arranged on the upper support main body 2, a water tank 7 detachably arranged on the toilet seat component 10 or the upper support main body 2, and a bedpan 3 detachably arranged on the toilet seat component 10.

When in a storage state, the bottom support main body 1 is at least partially placed inside the upper support main body 2, and the bedpan 3 and the water tank 7 are both at least partially placed inside the bottom support main body 1. When in a usage state, the bottom support main body 1 is positioned below the upper support main body 2, the toilet seat component 10 is positioned above the upper support main body 2 and is configured for limiting a position of the bedpan 3, the bedpan 3 is at least partially placed inside the upper support main body 2, and the water tank 7 is positioned behind the bedpan 3 and above the upper support main body 2.

In this embodiment, the bottom support main body 1 and the toilet seat component 10 are both detachably connected to the upper support main body 2, the water tank 7 is detachably arranged on the upper support main body 2 and the toilet seat component 10, and the bedpan 3 is detachably arranged on the toilet seat component 10. Therefore, during storage, the bottom support main body 1 is at least partially placed inside the upper support main body 2, the bedpan 3 and the water tank 7 are both at least partially placed inside the bottom support main body 1, and then the toilet seat component 10 can be positioned on an outside of the upper support main body 2 and an outside of the bottom support main body 1, thereby playing a storage role, effectively reducing the volume of the product during carrying and transportation, and facilitating transportation and outdoor carrying.

In one embodiment, a first embedding groove 11 is defined in an upper surface of the bottom support main body 1. The bottom support main body 1 is provided with first engaging openings 12 on a side wall of the first embedding groove 11. A bottom portion of the upper support main body 2 protrudes downward to form a first connecting flange 21. First engaging blocks 23 are provided on a side wall of the first connecting flange 21. When in the usage state, the first connecting flange 21 is placed in the first embedding groove 11, a bottom portion of the first connecting flange 21 is in contact with a bottom surface of the first embedding groove 11, and the first engaging block 23 is placed in the first engaging opening 12 to fix the upper support main body 2 on the bottom support main body 1. By placing the first connecting flange 21 in the first embedding groove 11, an area of connection between the bottom support main body 1 and the upper support main body 2 can be increased, thereby improving the stability of the connection. Moreover, the bottom portion of the first connecting flange 21 is in contact with a bottom portion of the first embedding groove 11, the bottom surface of the first embedding groove 11 can be used for supporting the upper support main body 2.

In the above embodiment, the upper support main body 2 is in a hollow form, and a top portion of the upper support main body 2 is a first opening 13. Through the first opening 13, the upper support main body 2 can accommodate the bottom support main body 1.

In one embodiment, the first connecting flange 21 is provided with a first avoidance opening 22 at a position corresponding to the first engaging block 23, which allows the first engaging block 23 to have elasticity. The first engaging block 23 includes a first support portion 231 connected to the first connecting flange 21, and a first convex block 232 arranged on a side wall of the first support portion 231. A thickness of the first convex block 232 gradually decreases at least partially in a direction close to the bottom support main body 1. The first avoidance opening 22 and the first support portion 231 are displayed in a projection of the upper support main body 2 from top to bottom. According to the above structure, after the toilet seat component 10 and the upper support main body 2 are disassembled, looking from the first opening 13 towards the bottom portion of the upper support main body 2, the first avoidance opening 22 and the first support portion 231 can be seen, that is, the first support portion 231 is exposed, so that when the upper support main body 2 and the bottom support main body 1 are separated in opposite directions by force but fail be separated, the first support portion 231 can be manually moved to allow the first convex block 232 to detach from the first engaging opening 12, thereby separating the upper support main body 2 from the bottom support main body 1.

In the above embodiment, the bottom support main body 1 is in a hollow form, and a bottom portion of the bottom support main body 1 is a second opening 24. Through the second opening 24, the bedpan 3 and the water tank 7 are stored inside the bottom support main body 1.

In one embodiment, a plurality of ribs 15 are arranged around an inner side wall of the bottom support main body 1 for enhancing strength of the bottom support main body 1. By utilizing the rib 15, the overall strength of the bottom support main body 1 can be strengthened, thereby improving a support force.

In one embodiment, anti-slip pads 16 are provided at the bottom portion of the bottom support main body 1 to provide anti-slip function.

In one embodiment, the toilet seat component 10 includes a toilet ring 4, a seat ring 5, and a toilet lid 6. The toilet ring 4 is detachably arranged on the upper support main body 2. The seat ring 5 is rotatably arranged on the toilet ring 4, and the seat ring 5 is configured to be detachably arranged on the toilet ring 4. The toilet lid 6 is rotatably arranged on the toilet ring 4. The seat ring 5 is positioned between the toilet ring 4 and the toilet lid 6. Therefore, the toilet ring 4, the seat ring 5, and the toilet lid 6 form one component, and when the toilet ring 4 is separated from the upper support main body 2, the entire toilet seat component 10 can be detached from the upper support main body 2.

A third opening 43 is defined in the toilet ring 4. The third opening 43 is in communication with an inner portion of the upper support main body 2. The bedpan 3 is provided with a support rim 31. The bedpan 3 is placed inside the third opening 43. The support rim 31 is positioned above an upper surface of the toilet ring 4 to facilitate the installation and removal of the bedpan 3 by the user. When the toilet lid 6 is opened, the user can sit on the toilet ring 4 or the seat ring 5 and use the bedpan 3 to use the toilet. In this embodiment, the seat ring 5 is detachably arranged on the toilet ring 4, that is, the seat ring 5 can be removed from the toilet ring 4 and used on a household toilet.

In the above embodiment, the toilet ring 4 is detachably connected to the upper support main body 2 through a buckle structure.

In one embodiment, the toilet ring 4 is provided with a second embedding groove 44 on a peripheral side corresponding to the third opening 43. The second embedding groove 44 is adapted for use with the support rim 31. The support rim 31 is placed in the second embedding groove 44 to prevent the support rim 31 from protruding and affecting the user experience.

In one embodiment, a front end of the bedpan 3 is formed with a flow guide portion 32 for easy pouring of excrement. By using the flow guide portion 32, excrement can be discharged along the flow guide portion 32, improving the user experience.

In one embodiment, the toilet ring 4 protrudes upward on a rear side of the third opening 43 to form at least two first connecting columns 45. The at least two first connecting columns 45 are spaced apart. A side wall of the first connecting column 45 protrudes to form a first rotating shaft portion 451. The toilet lid 6 protrudes at a position near an end portion to form a second connecting column 61. A first shaft hole 62 is defined in a side wall of the second connecting column 61. The first rotating shaft portion 451 is placed inside the first shaft hole 62, so that the toilet lid 6 is rotationally provided on the toilet ring 4. Of course, the first connecting column 45 can also be provided on the toilet lid 6, and the second connecting column 61 can be provided on the toilet ring 4.

In one embodiment, the seat ring 5 is provided with a second avoidance opening 56 at a position corresponding to the second connecting column 61 to prevent the seat ring 5 from affecting the rotation of the toilet lid 6.

In one embodiment, the toilet ring 4 is provided with a third avoidance opening 47 at a position corresponding to rotation of the seat ring 5, to prevent an upper surface of the toilet lid 6 from affecting the rotation of the seat ring 5. Specifically, a bottom surface of the third avoidance opening 47 is curved to allow the seat ring 5 to rotate smoothly. Of course, the bottom surface of the third avoidance opening 47 can also be formed by a flat surface and/or a curved surface.

In one embodiment, a bottom portion of the seat ring 5 is provided with a cushion pad 52 for preventing collision with the toilet ring 4. When the seat ring 5 is put down for use, the cushion pad 52 can be used to cushion, which can prevent collision between the seat ring 5 and the toilet ring 4, and can reduce a sound of contact between the seat ring 5 and the toilet ring 4.

In one embodiment, an upper surface of the seat ring 5 is provided with a seat cushion 51 for increasing user comfort.

In one embodiment, the upper surface of the seat ring 5 is recessed downward to form a third embedding groove 55. The seat cushion 51 is at least partially placed in the third embedding groove 55 to limit a position of the seat ring 5.

In one embodiment, the seat ring 5 is provided with a plurality of second engaging openings 53 on a side wall corresponding to the third embedding groove 55. An outer side of the seat cushion 51 is provided with a second engaging block 54 adapted for use with the second engaging opening 53. When the seat cushion 51 is placed in the third embedding groove 55, the second engaging block 54 is placed in the second engaging opening 53 to further fix the seat cushion 51.

In one embodiment, the toilet ring 4 protrudes upward on a rear side of the third opening 43 to form at least two third connecting columns 46. The at least two third connecting columns 46 are spaced apart. A side wall of the third connecting column 46 protrudes to form a second rotating shaft portion 461. The seat ring 5 protrudes at a position near an end portion to form a fourth connecting column 57. A second shaft hole 58 is defined in the fourth connecting column 57. The second rotating shaft portion 461 is placed in the second shaft hole 58 when the seat ring 5 is assembled to the toilet ring 4, so as to achieve the rotational arrangement of the seat ring 5 and the toilet ring 4.

In one embodiment, the second rotating shaft portion 461 is provided with a position limiting convex block 462. The position limiting convex block 462 is arranged opposite to the third connecting column 46. The fourth connecting column 57 is provided with an installation opening 59 for allowing the position limiting convex block 462 to pass through. The installation opening 59 is in communication with the second shaft hole 58. That is, when the seat ring 5 is installed on the toilet ring 4, the second rotating shaft portion 461 passes through the second shaft hole 58, and the position limiting convex block 462 passes through the installation opening 59. After rotation, the position limiting convex block 462 is limited by the fourth connecting column 57, and the second rotating shaft portion 461 will no disengage from the second shaft hole 58, thereby improving the stability of the rotational connection between the seat ring 5 and the toilet ring 4.

In the above embodiment, the third connecting column 46 is spaced apart from the first connecting column 45, so as not to affect both the toilet lid 6 and the seat ring 5 to be rotatably connected to a surface of the toilet ring 4.

In one embodiment, by using the water tank 7, a position of rotation of the seat ring 5 and the toilet lid 6 is limited. That is, the seat ring 5 is placed horizontally with the toilet ring 4 when in the usage state. The seat ring 5 is basically perpendicular to the toilet ring 4 when the seat ring 5 is in an open state. The position limiting convex block 462 is at least partially misaligned with the installation opening 59 when the seat ring 5 is in the use state and the open state. Since most of the states of the seat ring 5 are in the use state or the open state, and the position limiting convex block 462 is at least partially misaligned with the installation opening 59 when the seat ring 5 is in the use state and the open state, the position limiting convex block 462 can be prevented from detaching from the installation opening 59 when the seat ring 5 is in the use state and the open state, thereby improving the stability of connection between the seat ring 5 and the toilet ring 4.

In one embodiment, a partition plate 77 is detachably provided inside the water tank 7. The partition plate 77 is used for dividing an interior of the water tank 7 into an upper chamber 76 and a lower chamber 75. The upper chamber 76 and the lower chamber 75 are distributed up and down. The upper chamber 76 is used for storing items. The water tank 7 is internally equipped with a drawable hanging rod 752. The hanging rod 752 is at least partially placed inside the lower chamber 75. The water tank 7 is provided with a through hole 74 for communication with the upper chamber 76. By using the partition plate 77, items placed can be supported. Specifically, the upper chamber 76 can be used for holding roll paper or tissues, and tissues can pass through the through hole 74, making it convenient for the user can take tissues for use after using the toilet, and facilitating the daily user of tissues by the user. When the user needs to use the hanging rod 752, the hanging rod 752 can be pulled out of the lower chamber 75 to hang hooks, roll paper, towels, etc.

In one embodiment, a position limiting rod 751 is provided inside the lower chamber 75. A storage chamber 753 is defined in the position limiting rod 751. The storage chamber 753 is adapted to the hanging rod 752 and used for storing the hanging rod 752. The position limiting rod 751 is at least partially placed inside the storage chamber 753. One end of the position limiting rod 751 is fixed to the water tank 7. By configuring the position limiting rod 751 and the storage chamber 753, the installation structure of the hanging rod 752 can be made more compact, and the pulling of the hanging rod 752 can be made smoother and more stable.

In one embodiment, a fourth opening 721 is defined in a top portion of the water tank 7. The fourth opening 721 is in communication with the upper chamber 76 and facilitates the user to place items into the upper chamber 76. A cover plate 73 is rotationally provided on the water tank 7 at a position corresponding to fourth opening 721. The cover plate 73 is used for covering the fourth opening 721. By rotationally opening the cover plate 73, items inside the upper chamber 76 can be accessed or items can be placed inside the upper chamber 76 through the fourth opening 721.

In one embodiment, the water tank 7 is equipped with a sound emitting module 70 for emitting a sound of toilet flushing. Specifically, the sound emitting module 70 includes an outer shell 702, a circuit board 707 positioned inside the outer shell 702, a speaker 703, and an operation key 700 for user operation. The speaker 703 and the operation key 700 are both electrically connected to the circuit board 707. When the operation key 700 is operated, the circuit board 707 drives the speaker 703 to emit the sound of toilet flushing. After using the toilet, children can operate the operation key 700 to drive the speaker 703 through the circuit board 707 to produce the sound of toilet flushing, so that the child can develop the habit of flushing after using the toilet.

In one embodiment, the operation key 700 includes a trigger switch 706, a rotating member 701, and a restoration member 705. The trigger switch 706 is arranged on the circuit board 707. The rotating member 701 is rotationally provided on the outer shell 702. The rotating member 701 is partially placed inside the outer shell 702. The rotating member 701 is provided with a pressing member 704 at a position within the outer shell 702. When the rotating member 701 is operated to rotate, the pressing member 704 rotates together and presses the trigger switch 706. The circuit board 707 drives the speaker 703 to emit the sound of toilet flushing when the trigger switch 706 is pressed. The restoration member 705 is configured for generating a restoration force after the rotating member 701 is rotated, so as to drive the rotating member 701 back to a position before rotation. In this way, after using the toilet, children can rotate the rotating member 701 to allow the speaker 703 to emit the sound of toilet flushing. Moreover, after the rotating member 701 is rotated, the rotating member 701 can be restored to an initial position under the action of the restoration member 705 after the rotating member 701 is released. Specifically, the restoration member 705 is a torsion spring. The torsion spring is sleeved on the rotating member 701. One end of the torsion spring is fixed on the rotating member 701, and an opposite end of the torsion spring abuts against or is connected to the outer shell 702, so that when the rotating member 701 rotates, the torsion spring can be compressed and generate a restoration force. After the user releases the rotating member 701, by using the restoration force of the torsion spring, the rotating member 701 can rotate to the initial position for next use. Of course, in other embodiments, the operation key may also be a touch button, a dip switch, or key switch.

In one embodiment, the sound emitting module 70 further includes a battery 708. The battery 708 is electrically connected to the circuit board 707. Moreover, the outer shell 702 is provided with a placement slot, and a detachable battery cover 709 is provided at a slot opening of the placement slot for replacing the battery 708.

In one embodiment, the water tank 7 includes a tank body 71 with a fifth opening 711 at a top portion, and a front shell 72 detachably arranged on the tank body 71, so that when the pedestal type toilet 100 is stored in this embodiment, the front shell 72 can be disassembled, allowing the bedpan 3 to be partially placed inside the tank body 71. The outer shell 702 is fixed on the front shell 72. The bottom support main body 1 is provided with a first position limiting chamber 14 for limiting a position of the tank body 71. The tank body 71 is placed in the first position limiting chamber 14 when in the storage state, so as to achieve the function of the limiting the position of the tank body 71. Specifically, the first position limiting chamber 14 can be a hole passing through the bottom support main body 1 or formed by a surrounding side wall, etc. The front shell 72 can be stored between the upper support main body 2 and the bottom support main body 1, and of course, the front shell 72 can also be stored inside the bottom support main body 1.

In the above embodiment, support convex blocks 754 are provided on an inner side wall of the water tank 7 for supporting the partition plate 77. When the partition plate 77 is placed inside the water tank 7, the partition plate 77 is supported by the support convex block 754 to divide the interior of the water tank 7 into the upper chamber 76 and the lower chamber 75 which are distributed up and down. The sound emitting module 70 is arranged on the front shell 72.

In one embodiment, a bottom portion of the tank body 71 protrudes downward to form a second connecting flange 78. A third engaging block 781 is provided on a side wall of the second connecting flange 78. A fourth embedding groove 41 is defined in an upper surface of the toilet ring 4. The toilet ring 4 is provided with a third engaging opening 42 on a side wall of the fourth embedding groove 41. When in the usage state, the second connecting flange 78 is placed in the fourth embedding groove 41, and a bottom portion of the second connecting flange 78 is in contact with a bottom portion of the fourth embedding groove 41. The third engaging block 781 is placed in the third engaging opening 42. By using the second connecting flange 78 in conjunction with the fourth embedding groove 41, a connection area between the tank body 71 and the toilet ring 4 can be increased. Moreover, the third engaging block 781 is placed inside the third engaging opening 42, the stability of the connection between the tank body 71 and the toilet ring 4 can be improved.

In one embodiment, the second connecting flange 78 is provided with a fourth avoidance opening 782 at a position corresponding to the third engaging block 781. The third engaging block 781 includes a second support portion 7811 connected to the second connecting flange 78, and a second convex block 7812 provided on a side wall of the second support portion 7811. A thickness of the second convex block 7812 gradually decreases at least partially in a direction close to the toilet ring 4. The fourth avoidance opening 782 and the second support portion 7811 are displayed in a projection of the tank body 71 from top to bottom. According to the above structure, looking from the fourth opening 721 towards the bottom portion of the tank body 71, the fourth avoidance opening 782 and the second support portion 7811 can be seen, that is, the second support portion 7811 is exposed, so that when it is inconvenient to disassemble the tank body 71 and the toilet ring 4, the second support portion 7811 can be manually moved to allow the second convex block 7812 to detach from the third engaging opening 42, thereby separating the tank body 71 from the toilet ring 4.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. A pedestal type toilet for children, comprising:

a bottom support main body;

an upper support main body detachably connected to the bottom support main body;

a toilet seat component detachably arranged on the upper support main body;

a water tank detachably arranged on the toilet seat component or the upper support main body; and a bedpan detachably arranged on the toilet seat component;

wherein when in a storage state, the bottom support main body is at least partially placed inside the upper support main body, and the bedpan and the water tank are both at least partially placed inside the bottom support main body;

when in a usage state, the bottom support main body is positioned below the upper support main body, the toilet seat component is positioned above the upper support main body and is configured for limiting a position of the bedpan, the bedpan is at least partially placed inside the upper support main body, and the water tank is positioned behind the bedpan and above the upper support main body.

2. The pedestal type toilet for children according to claim 1, wherein a first embedding groove is defined in an upper surface of the bottom support main body; the bottom support main body is provided with first engaging openings on a side wall of the first embedding groove; a bottom portion of the upper support main body protrudes downward to form a first connecting flange; and first engaging blocks are provided on a side wall of the first connecting flange;

when in the usage state, the first connecting flange is placed in the first embedding groove, a bottom portion of the first connecting flange is in contact with a bottom portion of the first embedding groove, and the first engaging block is placed in the first engaging opening.

3. The pedestal type toilet for children according to claim 2, wherein the upper support main body is in a hollow form, and a top portion of the upper support main body is a first opening;

the first connecting flange is provided with a first avoidance opening at a position corresponding to the first engaging block; the first engaging block comprises a first support portion connected to the first connecting flange, and a first convex block arranged on a side wall of the first support portion; a thickness of the first convex block gradually decreases at least partially in a direction close to the bottom support main body; and the first avoidance opening and the first support portion are displayed in a projection of the upper support main body from top to bottom.

4. The pedestal type toilet for children according to claim 3, wherein the bottom support main body is in a hollow form, and a bottom portion of the bottom support main body is a second opening;

a plurality of ribs are arranged around an inner side wall of the bottom support main body for enhancing strength of the bottom support main body; and anti-slip pads are provided at the bottom portion of the bottom support main body.

5. The pedestal type toilet for children according to claim 1, wherein the toilet seat component comprises a toilet ring, a seat ring, and a toilet lid; the toilet ring is detachably arranged on the upper support main body; the seat ring is rotatably arranged on the toilet ring; the seat ring is configured to be detachably arranged on the toilet ring; the toilet lid is rotatably arranged on the toilet ring; and the seat ring is positioned between the toilet ring and the toilet lid;

a third opening is defined in the toilet ring; the third opening is in communication with an inner portion of the upper support main body; the bedpan is provided with a support rim; the bedpan is placed inside the third opening; and the support rim is positioned above an upper surface of the toilet ring.

6. The pedestal type toilet for children according to claim 5, wherein the toilet ring is provided with a second embedding groove on a peripheral side corresponding to the third opening; the second embedding groove is adapted for use with the support rim; and the support rim is placed in the second embedding groove.

7. The pedestal type toilet for children according to claim 5, wherein a front end of the bedpan is formed with a flow guide portion for easy pouring of excrement.

8. The pedestal type toilet for children according to claim 5, wherein the toilet ring protrudes upward on a rear side of the third opening to form at least two first connecting columns; the at least two first connecting columns are spaced apart; a side wall of the first connecting column protrudes to form a first rotating shaft portion; the toilet lid protrudes at a position near an end portion to form a second connecting column; a first shaft hole is defined in a side wall of the second connecting column; and the first rotating shaft portion is placed inside the first shaft hole.

9. The pedestal type toilet for children according to claim 8, wherein the seat ring is provided with a second avoidance opening at a position corresponding to the second connecting column; and the toilet ring is provided with a third avoidance opening at a position corresponding to rotation of the seat ring.

10. The pedestal type toilet for children according to claim 5, wherein a bottom portion of the seat ring is provided with a cushion pad for preventing collision with the toilet ring;

an upper surface of the seat ring is provided with a seat cushion for increasing user comfort.

11. The pedestal type toilet for children according to claim 10, wherein the upper surface of the seat ring is recessed downward to form a third embedding groove; and the seat cushion is at least partially placed in the third embedding groove;

the seat ring is provided with a plurality of second engaging openings on a side wall corresponding to the third embedding groove; and an outer side of the seat cushion is provided with a second engaging block adapted for use with the second engaging opening.

12. The pedestal type toilet for children according to claim 5, wherein the toilet ring protrudes upward on a rear side of the third opening to form at least two third connecting columns; the at least two third connecting columns are spaced apart; a side wall of the third connecting column protrudes to form a second rotating shaft portion; the seat ring protrudes at a position near an end portion to form a fourth connecting column; a second shaft hole is defined in the fourth connecting column; and the second rotating shaft portion is placed in the second shaft hole when the seat ring is assembled to the toilet ring.

13. The pedestal type toilet for children according to claim 12, wherein the second rotating shaft portion is provided with a position limiting convex block; the position limiting convex block is arranged opposite to the third connecting column; the fourth connecting column is provided with an installation opening for allowing the position limiting convex block to pass through; and the installation opening is in communication with the second shaft hole;

the position limiting convex block is at least partially misaligned with the installation opening when the seat ring is in the use state and the open state.

14. The pedestal type toilet for children according to claim 5, wherein the water tank comprises a tank body with a fifth opening at a top portion, and a front shell detachably arranged on the tank body; the bedpan is at least partially placed inside the tank body when in the storage state; the bottom support main body is provided with a first position limiting chamber for limiting a position of the tank body; and the tank body is placed in the first position limiting chamber when in the storage state.

15. The pedestal type toilet for children according to claim 14, wherein a bottom portion of the tank body protrudes downward to form a second connecting flange; a third engaging block is provided on a side wall of the second connecting flange; a fourth embedding groove is defined in an upper surface of the toilet ring; the toilet ring is provided with a third engaging opening on a side wall of the fourth embedding groove; when in the usage state, the second connecting flange is placed in the fourth embedding groove, a bottom portion of the second connecting flange is in contact with a bottom portion of the fourth embedding groove, and the third engaging block is placed in the third engaging opening;

the second connecting flange is provided with a fourth avoidance opening at a position corresponding to the third engaging block; the third engaging block comprises a second support portion connected to the second connecting flange, and a second convex block provided on a side wall of the second support portion; a thickness of the second convex block gradually decreases at least partially in a direction close to the toilet ring; and the fourth avoidance opening and the second support portion are displayed in a projection of the tank body from top to bottom.

16. The pedestal type toilet for children according to claim 1, wherein a partition plate is detachably provided inside the water tank; the partition plate is used for dividing an interior of the water tank into an upper chamber and a lower chamber; the upper chamber and the lower chamber are distributed up and down; the upper chamber is used for storing items; the water tank is internally equipped with a drawable hanging rod; the hanging rod is at least partially placed inside the lower chamber; and the water tank is provided with a through hole for communication with the upper chamber.

17. The pedestal type toilet for children according to claim 16, wherein a position limiting rod is provided inside the lower chamber; a storage chamber is defined in the position limiting rod; the storage chamber is adapted to the hanging rod and used for storing the hanging rod; the position limiting rod is at least partially placed inside the storage chamber; and one end of the position limiting rod is fixed to the water tank.

18. The pedestal type toilet for children according to claim 16, wherein a fourth opening is defined in a top portion of the water tank; the fourth opening is in communication with the upper chamber and facilitates a user to place items into the upper chamber; a cover plate is rotationally provided on the water tank at a position corresponding to fourth opening; and the cover plate is used for covering the fourth opening.

19. The pedestal type toilet for children according to claim 1, wherein the water tank is equipped with a sound emitting module for emitting a sound of toilet flushing;

the sound emitting module comprises an outer shell, a circuit board positioned inside the outer shell, a speaker, and an operation key for user operation; the speaker and the operation key are both electrically connected to the circuit board; and when the operation key is operated, the circuit board drives the speaker to emit the sound of toilet flushing.

20. The pedestal type toilet for children according to claim 19, wherein the operation key comprises a trigger switch, a rotating member, and a restoration member; the trigger switch is arranged on the circuit board; the rotating member is rotationally provided on the outer shell; the rotating member is partially placed inside the outer shell; the rotating member is provided with a pressing member at a position within the outer shell; when the rotating member is operated to rotate, the pressing member rotates together and presses the trigger switch; the circuit board drives the speaker to emit the sound of toilet flushing when the trigger switch is pressed; and the restoration member is configured for generating a restoration force after the rotating member is rotated, so as to drive the rotating member back to a position before rotation.

* * * * *